United States Patent [19]

Dinegar et al.

[11] 4,316,412

[45] Feb. 23, 1982

[54] LOW VOLTAGE NONPRIMARY EXPLOSIVE DETONATOR

[75] Inventors: Robert H. Dinegar, Los Alamos, N. Mex.; John Kirkham, Newbury, England

[73] Assignee: The United States of America as represented by the United States Department of Energy, Washington, D.C.

[21] Appl. No.: 28,743

[22] Filed: Jun. 5, 1979

[51] Int. Cl.[3] ..... E42C 13/00

[52] U.S. Cl. ..... 102/202.5; 102/202.7

[58] Field of Search ..... 102/28 R, 28 EB

[56] References Cited

U.S. PATENT DOCUMENTS

| | | | |
|---|---|---|---|
| 2,525,397 | 10/1950 | Cairns et al. | 102/28 R |
| 2,761,386 | 9/1956 | Zebree | 102/28 R |
| 2,991,714 | 7/1961 | Noddin | 102/28 R |
| 3,096,714 | 7/1963 | Yuill . | |
| 3,158,097 | 11/1964 | Brockway et al. | 102/28 R |
| 3,212,439 | 10/1965 | Reyne | 102/28 R |
| 3,420,174 | 1/1969 | Potter | 102/28 R |
| 3,707,917 | 1/1973 | Zernow et al. . | |
| 3,724,383 | 4/1973 | Gallaghan et al. | 102/28 R |
| 3,978,791 | 9/1976 | Lemley et al. . | |

OTHER PUBLICATIONS

Sulimov et al., *On the Mechanism of Deflagration to Detonation Transition in Gas-Permeable High Explosive,* Proc. Sixth Symp. on Detonation, 8-1976, pp. 250-257.

*Primary Examiner*—Peter A. Nelson

*Attorney, Agent, or Firm*—Edward C. Walterscheid; Paul G. Gaetjens; James E. Denny

[57] ABSTRACT

A low voltage, electrically actuated, nonprimary explosive detonator is disclosed wherein said detonation is achieved by means of an explosive train in which a deflagration-to-detonation transition is made to occur. The explosive train is confined within a cylindrical body and positioned adjacent to low voltage ignition means have electrical leads extending outwardly from the cylindrical confining body. Application of a low voltage current to the electrical leads ignites a self-sustained deflagration in a donor portion of the explosive train which then is made to undergo a transition to detonation further down the train.

18 Claims, 4 Drawing Figures

LOW VOLTAGE NONPRIMARY EXPLOSIVE DETONATOR

BACKGROUND OF THE INVENTION

The invention described herein relates generally to improved detonator devices and more particularly to detonator devices which contain only nonprimary explosives. Because of their reduced sensitivity to shock, electrostatic charge, heat, and the like, such devices are far less hazardous than those which contain primary explosives.

In various types of military ordnance and in a great many applications of high explosives in the civil sector, there is a continuing demand for safe, reliable detonators which can be routinely actuated by small amounts of electrical energy.

Detonators employing only nonprimary explosives have been previously developed. One example known in the art as the "flying-plate" detonator is disclosed and claimed in U.S. Pat. No. 3,978,791 which was issued Sept. 7, 1976. In this detonator, low voltage current is passed through a small diameter bridge, heating it and igniting deflagration in a secondary donor explosive. The gas pressure produced by this deflagration causes the central portion of a metal disk to be sheared away and propelled down a hollow bore to impact on a secondary acceptor explosive with sufficient velocity and force to initiate detonation in the acceptor explosive. In this device there is no transition from deflagration to detonation in an explosive train, but rather the energy of the "flying plate" impacting on the acceptor explosive initiates detonation therein.

There are certain problems associated with the use of a "flying plate" in a detonator. In order to achieve proper detonation of the acceptor secondary explosive, U.S. Pat. No. 3,978,791 teaches that the "flying plate" must retain its structural integrity and not disintegrate into small fragments. Moreover, it must be accelerated so as to impact on the acceptor explosive with a velocity of at least one millimeter per microsecond.

SUMMARY OF THE INVENTION

We have found that in a detonator employing only nonprimary explosives with low voltage current hot bridge ignition, the use of a "flying plate" can be completely avoided by means of an explosive train wherein a deflagration-to-detonation transition occurs. In its broad scope, our invention encompasses a low voltage, hot bridge detonator which comprises (a) an explosive train of nonprimary explosive which undergoes a deflagration-to-detonation transition when properly ignited and confined, (b) means for containing and confining the explosive train after ignition until the deflagration-to-detonation transition occurs, and (c) hot bridge means for igniting the explosive train to a self-sustained deflagration within the confinement means.

The explosive train may comprise a donor charge, transition charge, and acceptor charge. In a preferred embodiment, the donor charge has a density substantially greater than that of the transition charge. It is also preferred that the donor charge have a diameter substantially greater than that of the transition charge. Various explosives as well as mixes of such explosives function quite well in the detonator of this invention.

DETAILED DESCRIPTION

Figure 1:
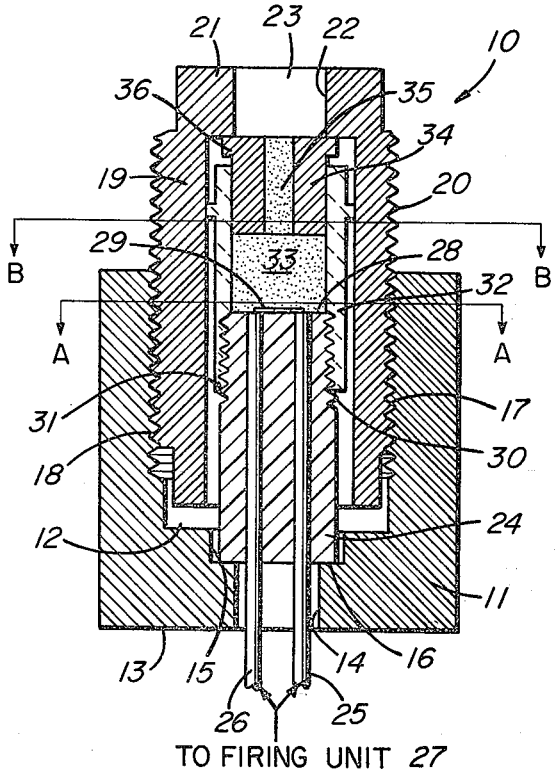
FIG. 1 is a cross sectional view of an embodiment of the invention wherein the diameter of the transition charge is substantially smaller than that of the donor charge.
Figure 3:
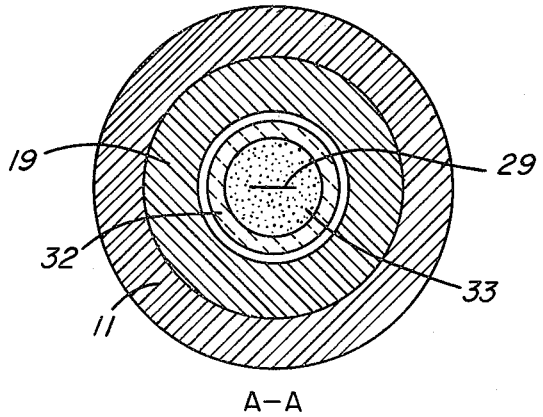
FIG. 3 is a cross sectional view along section A—A of the embodiment of FIG. 1.
Figure 4:
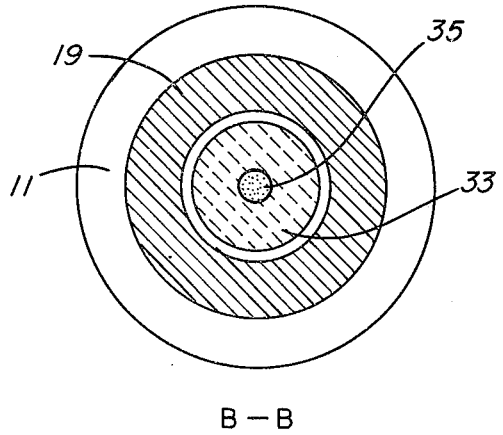
FIG. 4 is a cross sectional view along section B—B of the embodiment of FIG. 1.

As shown in the drawings, the detonator of the invention which is indicated generally at 10 utilizes hot bridge ignition of a self-sustaining deflagration in a donor nonprimary explosive. This deflagration in turn produces a deflagration-to-detonation transition in a transition nonprimary explosive which initiates detonation in an acceptor nonprimary explosive.

More specifically, the detonator shown in FIGS. 1–4 includes a generally cylindrically shaped body 11 having a chamber or bore 12 therein for containing other components of the device and having an end portion 13 with a small opening or aperture 14 therein. On the inside of end portion 13, aperture 14 is stepped to a larger diameter 15 which results in a lip 16. Cylindrical body 11 is open at the end opposite end portion 13 and has its interior wall 17 threaded 18 from the open end substantially through the length of chamber 12. Hollow cylindrical body 19 is provided with exterior threads 20 which permit it to be screwed into chamber 12 of cylindrical body 11. Cylindrical body 19 has end portion 12 having an aperture 22 in which is placed the acceptor nonprimary explosive 23.

Located within chamber 12 and resting on lip 16 is solid cylindrical insulator 24 which has electrical leads 25, 26 passing through the length thereof and out through aperture 14 to firing unit 27 (not shown). At the opposite end 28 of insulator 24, leads 25, 26 are connected to bridge 29. Insulator 24 has exterior threads 30 which permit it to mate with interior threads 31 of hollow cylinder 32.

Disposed within hollow cylinder 32 and in contact with bridge 29 is donor nonprimary explosive 33. In the embodiment of FIG. 1 also disposed in cylinder 32 is hollow sleeve 34 which rests on donor explosive 33. Transition nonprimary explosive 35 is contained in sleeve 24 and held in contact with both donor explosive 33 and acceptor explosive 23. Lip 36 serves to hold sleeve 34 in contact with end portion 21 of cylindrical body 19 when the detonator 10 is assembled.

As shown in FIG. 1, cylindrical bodies 11, 19, and 34 are composed of steel whereas cylindrical body 32 is brass. The materials used and the size of these components are not critical except to the extent that the materials used are compatible with the explosives employed and have adequate strength to confine the reaction products for a time sufficient for detonation to be achieved. It will be apparent that the strength of materials used plays an important part in miniaturizing the size of the detonator for use in, for example, various ordnance requirements.

Figure 2:
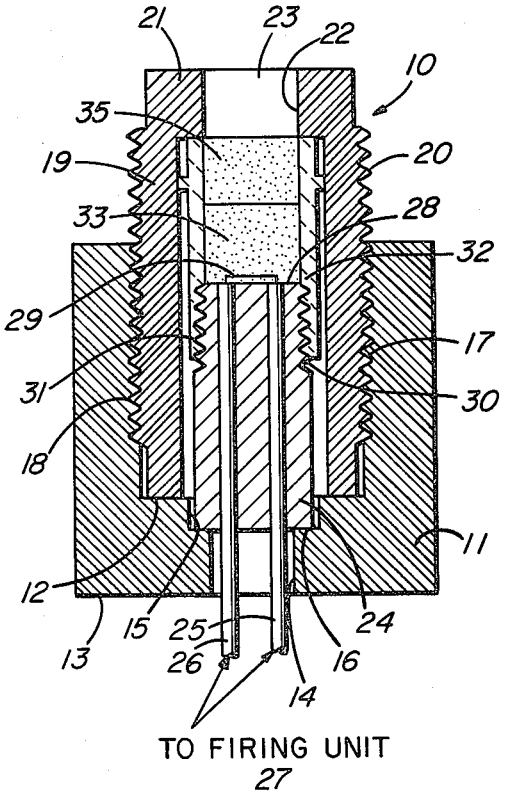
FIG. 2 is a cross sectional view of an embodiment of the invention wherein the diameters of the transition charge and the donor charge are essentially the same.

Insulator 24 can be made of any suitable insulating material as for example ceramic, glass, or plastic. It serves the dual purpose of insulating electrical leads 25, 26 and holding them in spaced relationship. Bridge 29 which in the embodiment of FIGS. 1 and 2 is soldered to leads 25, 26 at the end of insulator 24 adjacent to donor explosive charge 33 may be any material and shape which can be resistance heated sufficiently by low voltage current from leads 25, 26 to ignite deflagration in donor explosive charge 33. Desirably, the voltages and currents are in the area of several volts and several amperes. In a preferred embodiment, bridge 29 consists of a 1 mm length of 0.05 mm diameter Nichrome V (80% Ni, 20% Cr) wire. An applied voltage of 2.5 V across bridge wire 29 using this Nichrome V wire is quite sufficient to ignite to deflagration secondary explosives useful as donor charge 33.

A critical feature of the detonator of this invention is the use of a train of nonprimary explosives wherein the high pressure deflagration of donor charge 33 drives a stress wave in transition charge 35 in which the deflagration is transformed into a detonation which in turn produces detonation in acceptor charge 23. That is to say, operation of the detonator requires that a deflagration-to-detonation transition be produced in the explosive train.

As used in this application, a secondary or nonprimary explosive is one which has shock and bursting bridge wire sensitivity equal to or less than that of PETN (pentaerythritol tetranitrate). Examples include but are not limited to PETN, HMX (1,3,5,7-tetranitro-1,3,5,7-tetraazacyclooctane), RDX (1,3,5-trinitro-1,3,5-triazacyclohexane, HNAB (2,2',4,4',6,6'-hexanitroazobenzene), HNS (2,2',4,4',6,6'-hexanitrostilbene), KP (potassium picrate) or mixtures of these.

Donor charge or explosive 33 must be capable of being ignited by hot bridge 29 at low voltages and currents, typically on the order of several volts and amperes. The relative density of donor charge 33 can be important, depending on the particular explosives or explosive mixtures that are used. Likewise, the ratio of the diameter of donor charge 33 to that of transition charge 35 can be important. Generally speaking, it is preferred that the diameter of donor charge 33 be substantially greater than that of transition charge 35, although, as shown in FIG. 2 with certain nonprimary explosives they may be substantially the same. Finally, the particle size used in making up donor charge 33 and transition charge 35 can play a significant role.

Thus, for example, donor charge 33 and transition charge 35 may be pure PETN, HMX, or RDX if (a) there is a high density in donor charge 33 with a lower density in transition charge 35, and (b) the ratio of the diameter of donor charge 33 to that of transition charge 35 is large.

It should also be noted that KP mixed with PETN or HMX provides detonator explosives that can be ignited at low voltage levels with brizant reaction.

Experimental data obtained with the use of various nonprimary explosives or mixtures of nonprimary explosives are given in Tables I through XVII. The data of these tables were obtained using a 0.05 mm diameter Nichrome V bridge wire 1 mm long and an ignition voltage of 2.5 V in a detonator of the type shown in FIG. 1. No acceptor charge was used in the experimental run set forth in Table VIII. All other experimental runs made use of an acceptor charge consisting of PETN having a density of 1.6 g/cm$^3$ and a specific surface area $S_\sigma^p$ of 3300 cm$^2$/g. The acceptor charge had a diameter of 7.6 mm and a length of 5.1 mm. As used in the tables D indicates satisfactory detonation and ND indicates no detonation. In all tables which set forth experimental runs in which only one density for the transition charge is shown, satisfactory detonation was achieved.

The scope of the invention is not limited to the specific embodiments set forth herein but encompass any detonator employing only nonprimary explosives and low voltage hot bridge ignition wherein the detonation is produced by a deflagration-to-detonation transition in an explosive train.

TABLE I

| | |
|---|---|
| Donor Charge: | [1]90% PETN + 10% KP<br>[2]75% PETN + 25% KP<br>Density = 1.6 g/cm$^3$<br>Diameter = 7.6 mm<br>Length = 6.4 mm |
| Transition Charge: | PETN<br>Diameter = 2.5 mm<br>Length = 6.4 mm<br>Density = 1.0 g/cm$^3$<br>$S_\sigma^p$ = 3300 cm$^2$/g |

TABLE II

| | |
|---|---|
| Donor Charge: | [1]90% PETN + 10% KP<br>[2]75% PETN + 25% KP<br>[3]50% PETN + 50% KP<br>Density = 1.2 g/cm$^3$<br>Diameter = 7.6 mm<br>Length = 6.4 mm |
| Transition Charge: | PETN<br>Diameter = 2.5 mm<br>Length = 6.4 mm<br>Density = 1.0 g/cm$^3$<br>$S_\sigma^p$ = 3300 cm$^2$/g |

TABLE III

| | | |
|---|---|---|
| Donor Charge: | 90% PETN + 10% KP<br>Density = 1.6 g/cm$^3$<br>Diameter = 7.6 mm<br>Length = 6.4 mm | |
| Transition Charge: | PETN<br>Diameter = 2.5 mm<br>Length = 6.4 mm | |
| | | $S_\sigma^p$ (cm$^2$/g) |
| | | 3300 |
| Density (g/cm$^3$) | 0.6 | D |
| | 0.8 | D |
| | 1.0 | D |
| | 1.2 | D/ND |
| | 1.4 | ND |

TABLE IV

| | | |
|---|---|---|
| Donor Charge: | 90% PETN + 10% KP<br>Density = 1.2 g/cm$^3$<br>Diameter = 7.6 mm<br>Length = 6.4 mm | |
| Transition Charge: | PETN<br>Diameter = 2.5 mm<br>Length = 6.4 mm | |
| | | $S_\sigma^p$ (cm$^2$/g) |
| | | 3300 |
| Density (g/cm$^3$) | 0.8 | D |
| | 1.0 | D |
| | 1.2 | D |
| | 1.4 | ND |

TABLE V

| | |
|---|---|
| Donor Charge: | 90% PETN + 10% KP<br>Density = 1.6 g/cm$^3$<br>Diameter = 7.6 mm |

TABLE V-continued

| | | |
|---|---|---|
| Transition Charge: | Length = 6.4 mm<br>90% PETN + 10% KP<br>Diameter = 2.5 mm<br>Length = 6.4 mm | |
| | | $S_\sigma^p$ (cm²/g) |
| | | 3300 |
| Density (g/cm³) | 1.1 | D |
| | 1.2 | ND |
| | 1.4 | ND |
| | 1.6 | ND |

TABLE VI

| | | |
|---|---|---|
| Donor Charge: | 90% PETN + 10% KP<br>Density = 1.6 g/cm³<br>Diameter = 7.6 mm<br>Length = 6.4 mm | |
| Transition Charge: | HNAB<br>Diameter = 2.5 mm<br>Length = 6.4 mm | |
| | | $S_\sigma^p$ (cm²/g) |
| | | 6000 |
| Density (g/cm³) | 0.8 | D |
| | 1.0 | D |

TABLE VII

| | | |
|---|---|---|
| Donor Charge: | 90% PETN + 10% KP<br>Density = 1.6 g/cm³<br>Diameter = 7.6 mm<br>Length = 6.4 mm | |
| Transition Charge: | RDX<br>Diameter = 2.5 mm<br>Length = 6.4 mm | |
| | | $S_\sigma^p$ (cm²/g) |
| | | 6650 |
| Density (g/cm³) | 0.8 | D |
| | 1.0 | ND |

TABLE VIII

| | |
|---|---|
| Donor Charge: | RDX<br>Density = 1.5 g/cm³<br>Diameter = 7.6 mm<br>Length = 6.4 mm<br>$S_\sigma^p$ = 6650 cm²/g |
| Transition Charge: | PETN<br>Diameter = 2.5 mm<br>Length = 14.2 mm<br>Density = 1.0 g/cm³<br>$S_\sigma^p$ = 3500 cm²/g |

TABLE IX

| | | | | |
|---|---|---|---|---|
| Donor Charge: | PETN<br>Density = 1.6 g/cm³<br>Diameter = 7.6 mm<br>Length = 6.4 mm | | | |
| Transition Charge: | PETN<br>Diameter = 2.5 mm + 2.1 mm<br>Length = 6.4 mm + 6.4 mm | | | |
| | | PETN $S_\sigma^p$ (cm²/g) | | |
| | | 3500 | 8400 | 18000 |
| Density (g/cm³) | 0.8 | D | D | D |
| | 1.0 | D | D | D |
| | 1.2 | ND | D | ND |
| | 1.4 | ND | ND | ND |

TABLE X

| | | | | |
|---|---|---|---|---|
| Donor Charge: | PETN<br>Density = 1.6 g/cm³<br>Diameter = 7.6 mm<br>Length = 6.4 mm | | | |
| Transition Charge: | PETN<br>Diameter = 4.1 mm<br>Length = 12.8 mm | | | |
| | | PETN $S_\sigma^p$ (cm²/g) | | |
| | | 3500 | 8400 | 18000 |
| Density (g/cm³) | 0.8 | D | ND | — |
| | 1.0 | D | ND | — |
| | 1.2 | D | D | — |
| | 1.4 | D | D | — |

TABLE XI

| | | | | |
|---|---|---|---|---|
| Donor Charge: | PETN<br>Density = 1.4 g/cm³<br>Diameter = 7.6 mm<br>Length = 6.4 mm | | | |
| Transition Charge: | PETN<br>Diameter = 2.5 mm<br>Length = 6.4 mm | | | |
| | | PETN $S_\sigma^p$ (cm²/g) | | |
| | | 3450 | 8400 | 18000 |
| Density (g/cm³) | 0.8 | D | ND | — |
| | 1.0 | ND | ND | — |
| | 1.2 | D | ND | — |
| | 1.4 | D | ND | — |

TABLE XII

| | | | | |
|---|---|---|---|---|
| Donor Charge: | PETN<br>Density = 1.4 g/cm³<br>Diameter = 7.6 mm<br>Length = 6.4 mm | | | |
| Transition Charge: | PETN<br>Diameter = 4.1 mm<br>Length = 6.4 mm | | | |
| | | PETN $S_\sigma^p$ (cm²/g) | | |
| | | 3450 | 8400 | 18000 |
| Density (g/cm³) | 0.8 | D | ND | — |
| | 1.0 | D | D | — |
| | 1.2 | D | ND | — |
| | 1.4 | ND | ND | — |

TABLE XIII

| | | | | |
|---|---|---|---|---|
| Donor Charge: | PETN<br>Density = 1.4 g/cm³<br>Diameter = 7.6 mm<br>Length = 6.4 mm | | | |
| Transition Charge: | PETN<br>Diameter = 2.5 mm + 2.1 mm<br>Length = 6.4 mm + 6.4 mm | | | |
| | | PETN $S_\sigma^p$ (cm²/g) | | |
| | | 3450 | 8400 | 17000 |
| Density (g/cm³) | 0.8 | D | D | ND |
| | 1.0 | D | D | ND |
| | 1.2 | D | D | D |
| | 1.4 | D | ND | ND |

TABLE XIV

| | | | | |
|---|---|---|---|---|
| Donor Charge: | PETN<br>Density = 1.4 g/cm³<br>Diameter = 7.6 mm<br>Length = 6.4 mm | | | |
| Transition Charge: | PETN<br>Diameter = 4.1 mm<br>Length = 12.8 mm | | | |
| | | PETN $S_\sigma^p$ (cm²/g) | | |
| | | 3450 | 8400 | 17000 |
| Density (g/cm³) | 0.8 | D | D | — |

TABLE XIV-continued

| | | | |
|---|---|---|---|
| 1.0 | D | D | — |
| 1.2 | D | D | — |
| 1.4 | D | ND | — |

TABLE XV

| | | | | |
|---|---|---|---|---|
| Donor Charge: | HMX<br>Density = 1.6 g/cm$^3$<br>Diameter = 7.6 mm<br>Length = 6.4 mm | | | |
| Transition Charge: | HMX<br>Diameter = 2.1 mm<br>Length = 12.8 mm | | | |
| | | HMX $S_0^P$ (cm$^2$/g) | | |
| | | 3500 | 8300 | 19000 |
| Density (g/cm$^3$) | 0.8 | D | D | ND |
| | 1.0 | D | ND | ND |
| | 1.2 | ND | ND | ND |
| | 1.4 | ND | ND | — |

TABLE XVI

| | | | | |
|---|---|---|---|---|
| Donor Charge: | HMX<br>Density = 1.4 g/cm$^3$<br>Diameter = 7.6 mm<br>Length = 6.4 mm | | | |
| Transition Charge: | HMX<br>Diameter = 2.1 mm<br>Length = 12.8 mm | | | |
| | | HMX $S_0^P$ (cm$^2$/g) | | |
| | | 3500 | 8300 | 19000 |
| Density (g/cm$^3$) | 0.8 | D | D | — |
| | 1.0 | ND | ND | — |
| | 1.2 | ND | ND | — |
| | 1.4 | — | — | — |

TABLE XVII

| | | | | |
|---|---|---|---|---|
| Donor Charge: | HMX<br>Density = 1.4 g/cm$^3$<br>Diameter = 7.6 mm<br>Length = 6.4 mm | | | |
| Transition Charge: | HMX<br>Diameter = 4.1 mm<br>Length = 12.8 mm | | | |
| | | HMX $S_0^P$ (cm$^2$/g) | | |
| | | 3500 | 8300 | 19000 |
| Density (g/cm$^3$) | 0.8 | D | D | — |
| | 1.0 | ND | D | — |

We claim:

1. In a detonator employing only nonprimary explosives and low voltage hot bridge ignition, the improvement comprising use of an explosive train wherein a deflagration-to-detonation transition occurs.

2. The detonator of claim 1 wherein said explosive train comprises a donor explosive and a transition explosive.

3. The detonator of claim 2 wherein said donor explosive has a density which is substantially higher than that of said transition explosive.

4. The detonator of claim 2 wherein said donor explosive has a diameter substantially larger than that of said transition explosive.

5. The detonator of claims 2, 3, or 4 wherein said donor explosive comprises a mixture of potassium picrate and PETN, HMX, or RDX.

6. The detonator of claims 2, 3, or 4 wherein said donor explosive and said transition explosive are comprised of the same explosive or explosive mixture.

7. The detonator of claim 6 wherein the density of said donor explosive is about 20% to about 100% greater than that of said transition explosive.

8. A low voltage, hot bridge detonator which comprises (a) an explosive train of nonprimary explosives, said train undergoing a deflagration-to-detonation transition when properly ignited and confined, (b) means for containing and confining said train after ignition until said deflagration-to-detonation transition occurs, and (c) hot bridge means for igniting said explosive train to a self-sustained deflagration within said confinement means.

9. The detonator of claim 8 wherein said hot bridge means comprises a bridge wire attached to electrical leads, means for passing said electrical leads through said confinement means, and means for holding said bridge wire closely adjacent to one end of said explosive train, said bridge wire being adapted to ignite said explosive train in response to a low voltage current from said electrical leads.

10. The detonator of claim 9 wherein said explosive train comprises a donor charge disposed adjacent to said bridge wire and adapted to undergo self-sustained deflagration when ignited by said bridge wire, and a transition charge disposed adjacent to said donor charge and in contact therewith, said transition charge being adapted to undergo a deflagration-to-detonation transition within said confinement means.

11. The detonator of claim 10 wherein said donor charge has a density substantially greater than that of said transition charge.

12. The detonator of claim 11 wherein said donor charge has a density at least 20% greater than that of said transition charge.

13. The detonator of claim 10 wherein the ratio of the diameter of said donor charge to that of said transition charge is 1 or greater.

14. The detonator of claim 13 wherein said donor charge has a diameter substantially larger than that of said transition charge.

15. The detonator of claim 10, 11, 12, 13, or 14 wherein said explosive train has an acceptor charge disposed adjacent to and in contact with said transition charge.

16. The detonator of claim 6 wherein said donor explosive and said transition explosive are PETN, HMX, or RDX.

17. The detonator of claims 10, 11, 12, 13, or 14 wherein said bridge wire is adapted to ignite said explosive train in response to a current from said electrical leads produced by an applied voltage of about 2.5 volts or less.

18. The detonator of claims 10, 11, 12, 13, or 14 wherein said donor explosive and said transition explosive comprise the same explosive or explosive mixture.

* * * * *